US011742116B2

(12) United States Patent
Ushiyama et al.

(10) Patent No.: US 11,742,116 B2
(45) Date of Patent: Aug. 29, 2023

(54) CHIP RESISTOR

(71) Applicant: KOA CORPORATION, Ina (JP)

(72) Inventors: Kazuhisa Ushiyama, Ina (JP); Yuta Watanabe, Ina (JP)

(73) Assignee: KOA CORPORATION, Ina (JP)

( * ) Notice: Subject to any disclaimer, the term of this patent is extended or adjusted under 35 U.S.C. 154(b) by 0 days.

(21) Appl. No.: 17/741,568

(22) Filed: May 11, 2022

(65) Prior Publication Data

US 2022/0375661 A1 Nov. 24, 2022

(30) Foreign Application Priority Data

May 20, 2021 (JP) ..... 2021-085360

(51) Int. Cl.
*H01C 7/22* (2006.01)

(52) U.S. Cl.
CPC ..... *H01C 7/22* (2013.01)

(58) Field of Classification Search
CPC ..... H01C 7/22; H01C 17/22; H01C 17/242
See application file for complete search history.

(56) References Cited

U.S. PATENT DOCUMENTS 5,043,694 A * 8/1991 Higashi ..... H01C 17/24 338/195
6,462,304 B2 * 10/2002 Kaida ..... H01C 17/242 338/195
7,286,039 B2 * 10/2007 Yoneda ..... H01C 17/267 338/195
7,733,211 B2 * 6/2010 Yoneda ..... H01C 1/148 338/195
7,940,158 B2 * 5/2011 Yoneda ..... H01C 17/006 338/307
11,170,918 B2 * 11/2021 Ushiyama ..... H01C 7/22
2005/0275503 A1 * 12/2005 Yoneda ..... H01C 1/14 338/309
2021/0249164 A1 8/2021 Ushiyama et al.

FOREIGN PATENT DOCUMENTS

JP 2017152431 A * 8/2017
JP 2019-201142 A 11/2019

OTHER PUBLICATIONS

JP2017152431, Tanaka, machine translation. (Year: 2017).*

* cited by examiner

*Primary Examiner* — Kyung S Lee
(74) *Attorney, Agent, or Firm* — Oliff PLC

(57) ABSTRACT

The resistor 5 is a print-formed body including a meandering shaped first region 8 connected to the first front electrode 3 and a second region 9 connected to the first region 8 via a linking portion 10 and connected to the second front electrode 4. The first region 8 is provided with an I-cut shaped first trimming groove 11 and the second region 9 is provided with an L-cut shaped second trimming groove 12, and the side of the second region 9 positioned in the direction toward which a turn portion 12b of the second trimming groove 12 extends is an oblique side 9a that inclines to approach the second front electrode 4 as it approaches the connecting portion 7.

3 Claims, 4 Drawing Sheets

PRIOR ART

CHIP RESISTOR

TECHNICAL FIELD

The present invention relates to a chip resistor in which trimming grooves are formed on a resistor provided on an insulating substrate for the purpose of adjustment of a resistance value.

BACKGROUND ART

A chip resistor is designed to mainly include a rectangular parallelepiped insulating substrate, a pair of front electrodes oppositely disposed on the front surface of the insulating substrate with a predetermined interval therebetween, a pair of back electrodes oppositely disposed on the back surface of the insulating substrate with a predetermined interval therebetween, end face electrodes that bridges the front electrodes and the corresponding back electrodes, a resistor that bridges the pair of front electrodes, and a protective film for covering the resistor.

Generally, in the case of producing this type of chip resistor, after multi-piece electrodes, resistors, protective films, and the like are collectively formed on a large-sized substrate, the large-sized substrate is divided along grid-like division lines (for example, division grooves) to obtain multi-piece chip resistors. In the processes of producing this type of chip resistor, multi-piece chip resistors are obtained by printing the resistance pastes on one of the surfaces of the large-sized substrate and sintering the printed pastes. However, due to positional deviation and/or bleeding during printing, or influence of temperature unevenness in a sintering furnace, a little variation in size and film thickness among the resistors is caused. Accordingly, a resistance value adjustment operation, in which trimming grooves are formed on each resistor in a state where they are on the large-sized substrate so that a resistance value can be set to a desired resistance value, is performed in the processes above.

When surge voltage generated by static electricity, power supply noise, or the like is applied to the chip resistor designed as above, the characteristics of the resistor are affected by excessive electrical stress, and in the worst case, the resistor may be destroyed. It has been known that lengthening the resistor totally by forming it into a meandering shape causes the potential drop to be smoothed, thereby improving the surge characteristics.

As prior art of this type of chip resistor, as illustrated in FIG. 6, there has been proposed a chip resistor 1 including a meandering shaped resistor 105 which is print-formed, between a pair of front electrodes 101 provided on both ends of an insulating substrate 100, respectively, in such a manner that a first meandering portion 103 is consecutively connected to a second meandering portion 104 across an adjustment portion 102 provided on the center of the insulating substrate 100. The adjustment portion 102 is provided with an I-cut shaped first trimming groove 106 to make an electric current path of the resistor 105 long, whereby a resistance value of the resistor 105 can be roughly adjusted to be a value a little less than a target resistance value. Thereafter, an L-cut shaped second trimming groove 107 is provided in the second meandering portion 104, whereby the resistance value of the resistor 105 can be adjusted to match the target resistance value (see Patent Literature 1).

In the prior art disclosed in Patent Literature 1, the first trimming groove 106 is provided in the adjustment portion 102 of the resistor 105 which is print-formed in a meandering shape, whereby the resistance value of the resistor 105 is adjusted to be close to the target resistance value, and thereafter, the L-cut shaped second trimming groove 107 is provided in the second meandering portion 104, whereby the resistance value of the resistor 105 is adjusted to match the target resistance value. This enables improvement of the surge characteristics and adjustment of the resistance value with high accuracy.

CITATION LIST

Patent Literature

Patent Literature 1: JP-A-2019-201142

SUMMARY OF INVENTION

Technical Problem

In the chip resistor described in Patent Literature 1, an electric current flows through within the second meandering portion 104 of the resistor 105 in the shortest path indicated by an imaginary line E of FIG. 6, and the shortest path E is a portion where the electric current flows the most. Since the second trimming groove 107 is provided in an area of the second trimming groove 107 with the small electric current distribution, the resistance value of the resistor 105 can be finely adjusted to match the target resistance value in accordance with the trimming amount of the second trimming groove 107 while preventing the distal end of the second trimming groove 107 from going beyond the shortest path E. However, there may be cases where an initial resistance value of the resistor 105 to be print-formed varies. If the initial resistance value of the resistor 105 is too low relative to the target resistance value, it is necessary to make the second trimming groove 107 long so as to change the resistance value considerably. This may cause the distal end of the second trimming groove 107 after L-turning to go beyond the side of the second meandering portion 104, which results in separation of the second meandering portion 104.

The present invention has been made in view of such a circumstance of the prior art, and an object thereof is to provide a chip resistor capable of improving surge characteristics, and also finely adjusting a resistance value with high accuracy.

Solution to Problem

In order to achieve the object describe above, the present invention provides a chip resistor comprising: a rectangular parallelepiped insulating substrate; a first electrode and a second electrode that are oppositely disposed on the insulating substrate with a predetermined interval therebetween; and a resistor that bridges the first electrode and the second electrode, the resistor being provided with trimming grooves for adjusting a resistance value, wherein the resistor is a print-formed body in which a first region, a linking portion, and a second region are consecutively formed, the first region being connected to the first electrode and extending in a meandering shape, the second region being connected to the second electrode, and the linking portion being positioned between the first region and the second region, the resistor is provided with a first trimming groove for rough adjustment and a second trimming groove for fine adjustment, the first trimming groove being provided in the first region to make an electric current path of the resistor long, and the second trimming groove being provided in the second region, in the second region, a connecting portion located at a diagonal position of the linking portion overlaps the second electrode, and also a substantially triangular space with the connecting portion as an apex is provided between the second region and the second electrode, and where a distance between the first electrode and the second electrode is an X-direction and a direction perpendicular to the X-direction is an Y-direction, the second trimming groove is an L-cut shaped slit including a straight portion and a turn portion, the straight portion extending in the Y-direction from, as a start point, a side located on an extension line of the linking portion, and the turn portion extending in the X-direction from a distal end of the straight portion toward the space In the chip resistor designed as described above, the first trimming groove for making the electric current path of the resistor long is formed in the first region that is connected to the first electrode, whereby the resistance value increases in accordance with the trimming amount of the first trimming groove. This enables improvement of the surge characteristics, and also rough adjustment of the resistance value. Furthermore, the L-cut shaped second trimming groove is formed in the second region that is connected to the second electrode, whereby the resistance value can be finely adjusted with high accuracy. Still further, the space having a substantially triangular shape with the connecting portion as the apex is provided between the second region and the second electrode, and the space designed as described above is positioned at a distal end of the turn portion of the second trimming groove to face thereto. This increases, in accordance with extension of the straight portion of the second trimming groove, the area where the turn portion is able to be formed. Accordingly, even in the case where the initial resistance value of the resistor is too low and thus the second trimming groove should be made long, a possibility that the turn portion separates a part of the resistor is reduced, and as a result, it is possible to reduce failure of adjustment of the resistance value.

In the chip resistor designed as described above, in the case where a resistor width serving as an electric current path of the first region defined by the first trimming groove, a resistor width serving as an electric current path of the second region defined by the second trimming groove, and a resistor width of the linking portion in the Y-direction are set substantially equal to each other, the resistor is made long in the entire length from the first region to the second region through the linking portion. This enables improvement of the surge characteristics. And moreover, since the resistor width serving as the electric current path is made substantially equal among the first region, the second region, and the linking portion, it is possible to suppress the amount of change in the resistance value with respect to the overload.

In this case, when the first trimming groove is an I-cut shaped slit that extends in the Y-direction from, as a start point, a central portion of the first region in the X-direction, and a length of the first region in the X-direction is set to about twice a length of the linking portion in the Y-direction, by forming the first trimming groove having a predetermined length at a predetermined position of the print-formed body, it is possible to easily form the first region in a meandering shape having the substantially equal resistance width.

Advantageous Effects of Invention

According to the chip resistor of the present invention, it is possible to improve surge characteristics, and also possible to finely adjust a resistance value with high accuracy.

Each FIG. 2A-2D explains producing processes of the chip resistor according to the first embodiment.

Figure 3:
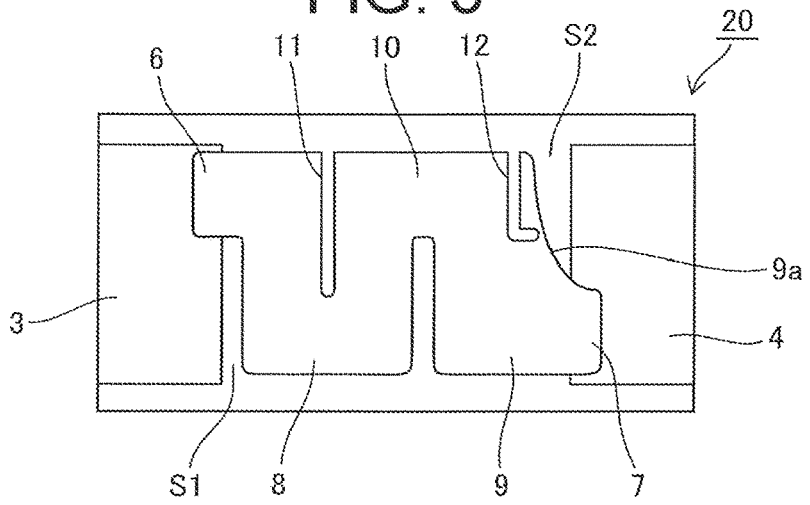

FIG. 3 is a plan view of a chip resistor according to a second embodiment.

Figure 4:
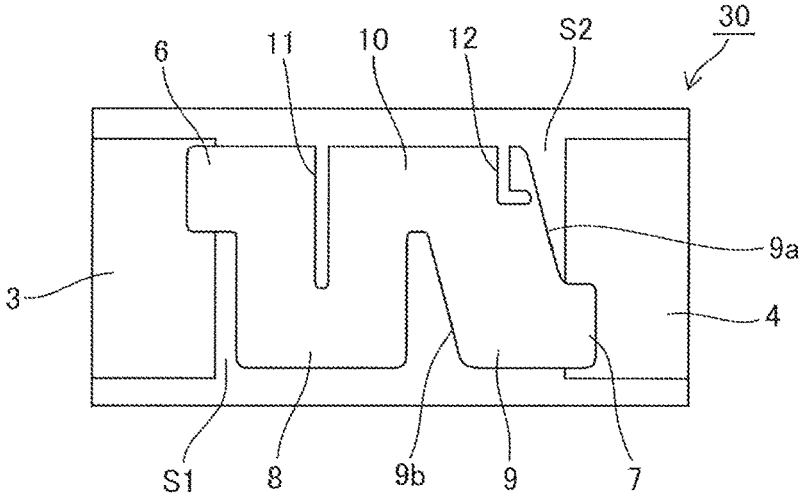

FIG. 4 is a plan view of a chip resistor according to a third embodiment

Figure 5:
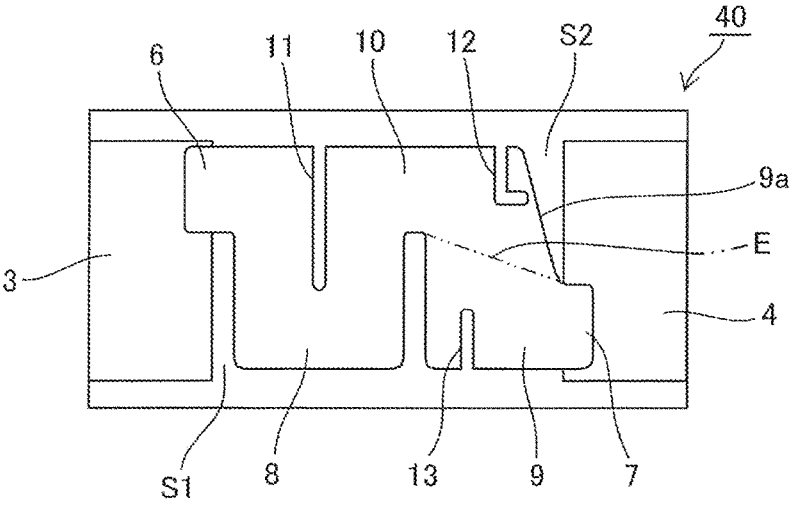

FIG. 5 is a plan view of a chip resistor according to a fourth embodiment

Figure 6:
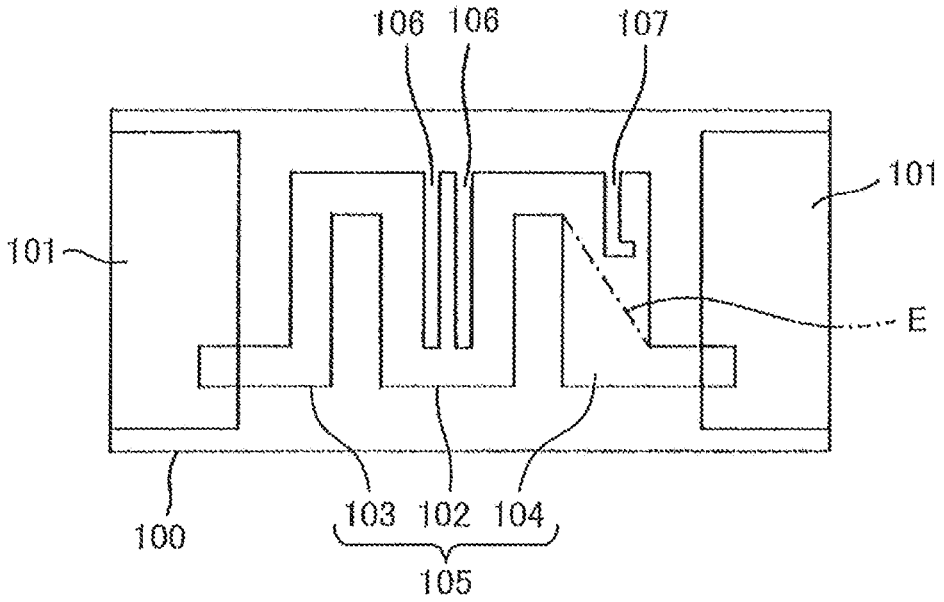

FIG. 6 is a plan view of a chip resistor according to prior art.

DESCRIPTION OF EMBODIMENTS

Hereinafter, embodiments of the present invention will be described with reference to the drawings.

Figure 1:
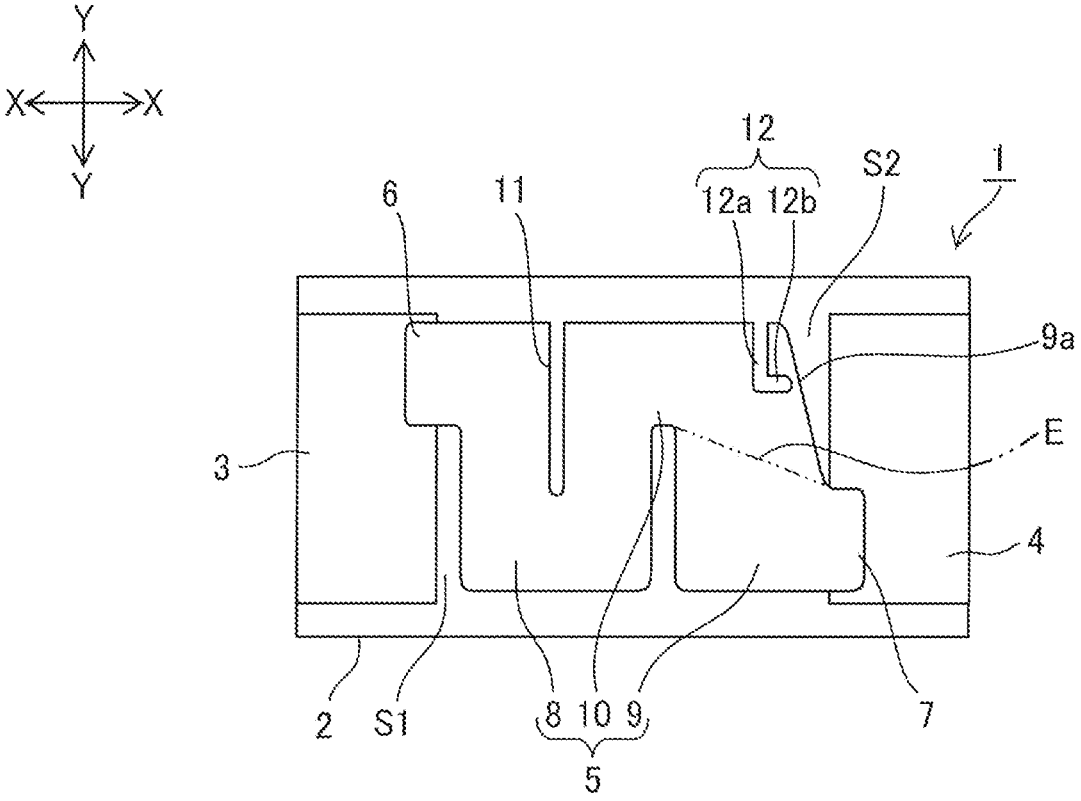
FIG. 1 is a plan view of a chip resistor according to a first embodiment.

FIG. 1 is a plan view of a chip resistor according to a first embodiment of the present invention. As illustrated in FIG. 1, a chip resistor 1 according to the first embodiment mainly includes an insulating substrate 2 having a rectangular parallelepiped shape, a first front electrode 3 and a second front electrode 4 provided at, in the longitudinal direction, both ends of the front surface of the insulating substrate 2, a resistor 5 provided on the front surface of the insulating substrate 2 so as to be connected to the first and second front electrodes 3, 4, and a protective coating layer (not illustrated) provided so as to cover the resistor 5. Although not illustrated, a pair of back electrodes which corresponds to the first and second front electrodes 3, 4, respectively, is provided on the back surface of the insulating substrate 2. Furthermore, each end face in the longitudinal direction of the insulating substrate 2 is provided with an end face electrode that bridges the corresponding front and back electrodes, and an external electrode that is plated to cover the end face electrode. In the following, the direction between the first and second front electrodes 3, 4 is referred to as X-direction, and the direction perpendicular to X-direction is referred to as Y-direction.

The resistor 5 is formed in a meandering shape, in which a first region 8 is consecutively connected to a second region 9 between a pair of connecting portions 6, 7 via a linking portion 10. The meandering shape described above is defined by the shape of printed resistor pastes. The connecting portion 6 illustrated on the left side of FIG. 1 overlaps an upper end portion of the first front electrode 3 formed in a rectangular shape, and the first region 8 is connected to the first front electrode 3 via the connecting portion 6. Furthermore, the connecting portion 7 illustrated on the right side of FIG. 1 overlaps a lower end portion of the second front electrode 4 formed in a rectangular shape, and the second region 9 is connected to the second front electrode 4 via the connecting portion 7 located at a diagonal position of the inking portion 10.

Each of the first region 8 and the second region 9 serves as an adjustment portion provided for adjusting a resistance value of the resistor 5, and an upper end portion of the first region 8 and an upper end portion of the second region 9 are connected to each other via the linking portion 10. The first region 8 is formed in a rectangular shape, and at an area which is between the first front electrode 3 and the first region 8 and is below the connecting portion 6, a rectangular shaped space S1 is provided. On the other hand, the second region 9 is formed in a polygonal shape having one oblique side 9*a*, and at an area between the second front electrode 4 and the oblique side 9*a* of the second region 9 and is above the connecting portion 7, a space S2 having a triangular shape with the connecting portion 7 as the apex is provided.

The first region 8 is provided with a first trimming groove 11, whereby a resistance value of the resistor 5 is roughly adjusted to be close to the target resistance value. The first trimming groove 11 is an I-cut shaped slit that extends in Y-direction from an upper side central portion of the first region 8 toward the lower side thereof. Forming the first trimming groove 11 designed as described above in the first region 8 causes the shape of the resistor 5 to meander twice, which makes an electric current path long.

The second region 9 is provided with a second trimming groove 12, whereby the resistance value of the resistor 5 is finely adjusted to be close to the target resistance value. The second trimming groove 12 is an L-cut shaped slit having a straight portion 12*a* and a turn portion 12*b*. The straight portion 12*a* extends in Y-direction from, as a start point, a position closer to the right side than an upper side central portion of the second region 9 toward the lower side. The turn portion 12*b* extends in X-direction from the distal end of the straight portion 12*a* toward the oblique side 9*a*.

Here, the distal end of the straight portion 12*a* of the second trimming groove 12 is set to be positioned not to go beyond an imaginary line E that connects the linking portion 10 and the connecting portion 7 illustrated on the right side of FIG. 1 in the shortest distance. Since a portion where an electric current flows the most in the second region 9 is the imaginary line E, the second trimming groove 12 is formed in an area of the second region 9 in which an electric current distribution is small. Furthermore, the triangular space S2 with the connecting portion 7 as the apex is provided between the second region 9 and the second front electrode 4, and the oblique side 9*a* of the second region 9 is formed along the hypotenuse of the space S2 designed as described above. This increases, in accordance with extension of the straight portion 12*a* of the second trimming groove 12, the length to the oblique side 9*a* of the second region 9 where the turn portion 12*b* is to be formed. Accordingly, even in the case where the initial resistance value of the resistor 5 is too low and thus the second trimming groove 12 should be made long, a possibility that the turn portion 12*b* of the second trimming groove 12 goes beyond the oblique side 9 of the second region 9 and thus separates a part of the resistor 5 is reduced. As a result, it is possible to reduce failure of adjustment of the resistance value.

Next, producing processes of the chip resistor 1 designed as described above will be explained with reference to each FIG. 2A~2D.

The first process is to prepare a large-sized substrate from which multi-piece insulating substrates 2 are obtained. In the large-sized substrate, the primary division groove and the secondary division groove, which respectively extend vertically and horizontally, are provided beforehand to form a grid pattern, and each one of the grids divided by the primary division groove and the secondary division groove serves as a single chip region. Each FIG. 2A~2D illustrates an exemplary large-sized substrate 2A corresponding to one chip region, but practically, the processes which will be described later are collectively performed on the large-sized substrate corresponding to multiple chip regions.

Figure 2A:
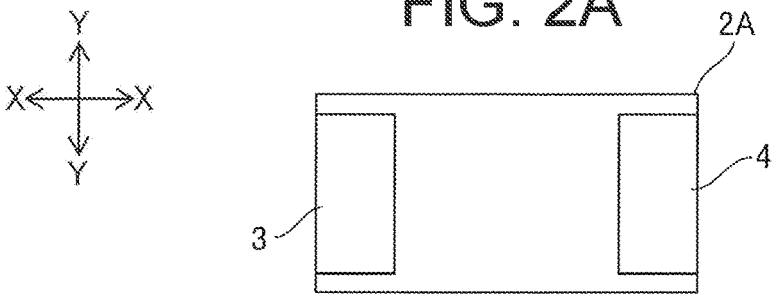

That is, as illustrated in FIG. 2A, after screen-printing the Ag-based pastes on the front surface of the large-sized substrate 2A, the process of drying and sintering the screen-printed pastes is performed to form the first front electrode 3 and the second front electrode (front electrode forming process). Simultaneously with or around the front electrode forming process, after screen-printing the Ag-based pastes on the back surface of the large-sized substrate 2A, the process of drying and sintering the screen-printed pastes is performed to form the pair of back electrodes (not illustrated) (back electrode forming process).

Figure 2B:
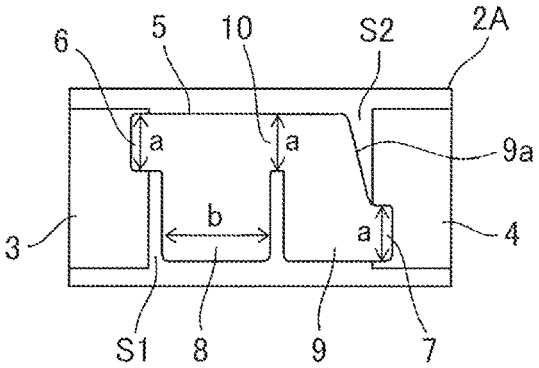

As illustrated in FIG. 2B, the next process is to screen-print the resistor pastes such as ruthenium oxide on the front surface of the large-sized substrate 2A, and then dry and sinter the screen-printed pastes to form the resistor 5 whose both ends in its longitudinal direction overlap the first front electrode 3 and the second front electrode 4, respectively (resistor forming process). The resistor 5 includes the connecting portion 6 that overlaps the front electrode 3, the first region 8 that is connected to the connecting portion 6, the connecting portion 7 that overlaps the second front electrode 4, the second region 9 that is connected to the connecting portion 7, and the linking portion 10 via which the first region 8 and the second region 9 is connected with each other.

Here, the first region 8 connected to the connecting portion 6 illustrated on the left side of FIG. 2B is formed in a rectangular shape, and at an area which is between the first front electrode 3 and the first region 8 and is below the connecting portion 6, the rectangular space S1 is provided. On the other hand, the second region 9 connected to the connecting portion 7 illustrated on the right side of FIG. 2B is formed in a polygonal shape having the oblique side 9*a*, and at an area between the second front electrode 4 and the oblique side 9*a* of the second region 9 and is above the connecting portion 7, the space S2 having a triangular shape with the connecting portion 7 as the apex is provided. In FIG. 2B, when the extension direction of the secondary division groove is X-direction and the extension direction of the primary division groove is Y-direction, the length of the connecting portion 6 and connecting portion 7, and the length of the linking portion 10 in Y-direction are all set to the same length-a, and the length-b of the first region 8 in X-direction is set to about twice the length-a (b is approximately equal to 2*a*). Note that the order of the front electrode forming process and the resistor forming process may be reversed, and thus for example, the first front electrode 3 and the second front electrode 4 may be formed so as to overlap both ends of the resistor 5, respectively, after the resistor 5 is formed.

Figure 2C:
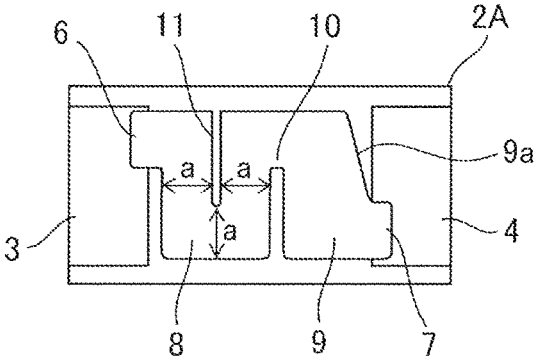

Next, after forming a pre-coat layer (not illustrated) for covering the resistor 5 by screen-printing the glass pastes over the resistor 5 and drying and sintering the printed glass pastes, a process of irradiating a laser beam from above the pre-coat layer is performed to form, as illustrated in FIG. 2C, the I-cut shaped first trimming groove 11 that extends in Y-direction from, as a start point, the upper side central portion of the first region 8. This first trimming groove 11 enables rough adjustment of the resistance value of the resistor 5 to a value slightly less than the target resistance value (resistance value rough adjustment process). Furthermore, forming the first trimming groove 11 designed as described above in the first region 8 allows the first region 8 that has been printed to be formed in a rectangular shape to be a meandering shape, in which its pattern width becomes the length-a which is equal to the resistor width of the connecting portions 6, 7 and linking portion 10.

Figure 2D:
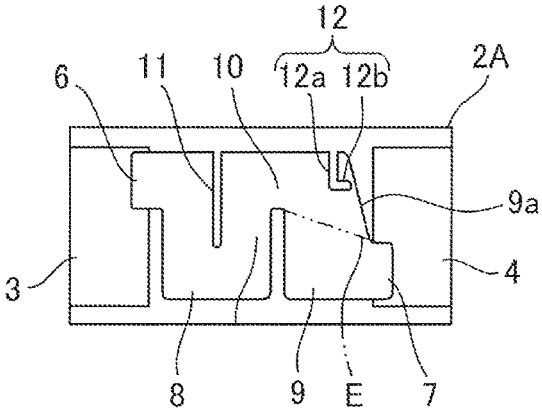

Next, as illustrated in FIG. 2D, the process of forming the second trimming groove 12 in the second region 9 is performed so that the resistance value of the resistor 5 is finely adjusted to match the target resistance value (resistance value fine adjustment process). The second trimming groove 12 is an L-cut shaped slit having the straight portion 12*a* and the turn portion 12*b*. The straight portion 12*a* extends in Y-direction, as a start point, from a position (position near an upper end of the oblique side 9*a*) closer to the right side than the upper side central portion of the second region 9 toward the lower side. The turn portion 12*b* extends in X-direction from the distal end of the straight portion 12*a* toward the oblique side 9*a*. The distal end of the straight portion 12*a* is prevented from going beyond the imaginary line E that connects the linking portion 10 and the connecting portion 7 illustrated on the right side of FIG. 2D in the shortest distance.

Here, a portion where the electric current flows the most in the second region 9 is the imaginary line E, and the second trimming groove 12 is formed in an area of the second region 9 in which an electric current distribution is small. Accordingly, the amount of change in the resistance value in accordance with the trimming amount of the second trimming groove 12 is very small, and as a result, the resistance value of the resistor 5 can be finely adjusted with high accuracy. Furthermore, the side of the second region 9 positioned in the direction toward which the turn portion 12*b* of the second trimming groove 12 extends is the oblique side 9*a* that inclines to approach the second front electrode 4 as it approaches the connecting portion 7. This increases, in accordance with extension of the straight portion 12*a* of the second trimming groove 12, the area where the turn portion 12*b* is able to extend. Accordingly, even in the case where the initial resistance value of the resistor 5 is too low and thus the second trimming groove 12 should be made long, a possibility that the turn portion 12*b* of the second trimming groove 12 goes beyond the oblique side 9 of the second region 9 and thus separates a part of the resistor 5 is reduced. As a result, it is possible to reduce failure of adjustment of the resistance value.

By forming the second trimming groove 12 in the second region 9, the distance between the linking portion 10 and the second trimming groove 12 defines an electric current path in the second region 9. In the present embodiment, the second trimming groove 12 is formed at a position closer to the second front electrode 4 than the upper side central portion of the second region 9 so that the resistor width of the electric current path in the second region 9 becomes substantially equal to the length-a of the linking portion 10 in Y-direction. Thus, forming the second trimming groove 12 for fine adjustment realizes the meandering shaped resistor 5 that is long in the entire length from the first region 8 to the second region 9 through the linking portion 10, and moreover, makes the resistor width serving as the electric current path substantially equal among the first region 8, the second region 9, and the linking portion 10.

Next, the process of screen-printing the epoxy resin pastes over the first trimming groove 11 and the second trimming groove 12 and heating and curing the screen-printed pastes is performed so as to form the protective coating layer (not illustrated) for covering the entire of the resistor 5 (protective coating layer forming process).

The processes up to here are collectively performed with respect to the large-sized substrate 2A from which multi-piece insulating substrates are obtained. In the next process, primary break processing for dividing the large-sized substrate 2A into strips along the primary division groove is performed so as to obtain strip-shaped substrates (not illustrated) provided with multi-piece chip regions (primary dividing process). Then, a process of sputtering Ni/Cr on divided faces of the strip-shaped substrate is performed so as to form end face electrodes (not illustrated) for bridging the first and second front electrodes 3, 4 and the corresponding back electrodes (end face electrode forming process).

Thereafter, secondary break processing for dividing the strip-shaped substrate along the secondary division groove is performed to obtain a chip unit having the same dimension as that of the chip resistor 1 (secondary dividing process). The final process is to form electrolytic plating (Ni plating and Sn plating) layers on both of the end faces in its longitudinal direction of the insulating substrate 2 for each divided chip unit so as to form the external electrodes (not illustrated) for covering the end face electrodes, the back electrodes, and the first and second front electrodes 3, 4 exposed from the protective coating layer. Through the processes above, it is possible to obtain the chip resistor 1 as illustrated in FIG. 1.

As described above, in the chip resistor 1 according to the first embodiment, the I-cut shaped first trimming groove 11 for making the electric current path of the resistor 5 long is formed in the first region 8 that is connected to the first front electrode 3, whereby the resistance value increases in accordance with the trimming amount of the first trimming groove 11. This enables improvement of the surge characteristics, and also rough adjustment of the resistance value. Furthermore, the L-cut shaped second trimming groove 12 is formed in the second region that is connected to the second front electrode 4, whereby the resistance value can be finely adjusted with high accuracy.

Still further, the space S having a substantially triangular shape with the connecting portion 7 as the apex is provided between the second region 9 and the second front electrode 4, and the space S2 designed as described above is positioned at a distal end of the turn portion 12*b* of the second trimming groove 12 to face thereto. This increases, in accordance with extension of the straight portion 12*a* of the second trimming groove 12, the area where the turn portion 12*b* is able to be formed. Accordingly, even in the case where the initial resistance value of the resistor 5 is too low and thus the second trimming groove 12 should be made long, a possibility that the turn portion 12*b* of the second trimming groove 12 goes beyond the oblique side 9 of the second region 9 and thus separates a part of the resistor 5 is reduced. As a result, it is possible to reduce failure of adjustment of the resistance value.

Still further, in the chip resistor 1 according to the first embodiment, after the resistor 5 is print-formed in such a manner that the first region 8 in X-direction becomes about twice the length of the linking portion 10 in Y-direction, the I-cut shaped first trimming groove 11 is formed at the central portion of the first region 8. This allows the first region 8 to have a meandering shape in which the resistor width of the first region 8 is substantially equal to that of the connecting portions 6, 7 and linking portion 10. Thereafter, the second trimming groove 12 is formed at a position closer to the second front electrode 4 than the second region 9, thereby making the resistor width serving as the electric current path substantially equal among the first region 8, the second region 9, and the linking portion 10. As a result, it is possible to suppress the amount of change in the resistance value with respect to the overload.

It should be noted that the present invention is not limited to the first embodiment described above, and various modifications are possible within the scope of the technical gist thereof.

For example, in the chip resistor 1 according to the first embodiment, the side of the second region 9 positioned in the direction toward which the turn portion 12*b* of the second trimming groove 12 extends is the oblique side 9*a* that linearly inclines toward the connecting portion 7. However, as in the case of a chip resistor 20 according to a second embodiment illustrated in FIG. 3, the oblique side 9*a* may be formed in an arc shape with a gentle curve. That is, near an area where the connecting portion 7 of the second region 9 is to overlap the second front electrode 4, a step is caused by the film thickness of the second front electrode 4, and thus the extrusion of the pastes at the time of print-forming the resistor 5 including the second region 9 is likely to cause bleeding near the connecting portion 7. This makes it difficult to realize the space S2 having a triangular shape with the connecting portion 7 as the apex, however, as in the case of the chip resistor 20 according to the second embodiment, when the side of the second region 9 opposed to the second front electrode 4 is the oblique side 9*a* formed in an arc shape with a gentle curve, the space S2 can be easily provided since the oblique side 9*a* is apart from the second front electrode 4.

Still further, as in the case of a chip resistor 30 according to a third embodiment illustrated in FIG. 4, an oblique side 9*b* that inclines in the same direction as that of the oblique side 9*a* may be formed in the second region 9 by cutting off a corner portion of the second region 9 facing the first region 8. The inclination angle of the oblique side 9*b* may not necessarily be parallel to the inclination angle of the oblique side 9*a*, however, since a portion to be cut for forming the oblique side 9*b* is an area of the second region 9 in which the electric current distribution is very small and which is not directly involved in the electric current path, the resistor material can be reduced in accordance with the cutting amount.

Still further, as in the case of a chip resistor 40 according to a fourth embodiment illustrated in FIG. 5, after forming the L-cut shaped second trimming groove 12 that extends from, as a start point, the upper side of the second region 9, an I-cut shaped second trimming groove 13 extending from the lower side to the upper side may be formed in the second region 9. Here, since a portion where the second trimming groove 13 is to be formed is in an area of the second region 9 in which the electric current distribution is very small, forming the second trimming groove 13 enables fine adjustment with considerable high accuracy. In this connection, the second trimming groove 13 may not be necessarily formed in an I-cut shape, but may be formed in an L-cut shape, J-cut shape, or the like.

Still further, in each of the above-described embodiments, the first trimming groove 11 to be formed in the first region 8 is one piece of I-cut shaped slit. However, the first trimming groove 11 may be formed with two pieces of I-cut slits. In such a case, in order to make the resistor width of the first region after forming the first trimming groove 11 substantially equal to the resistor width of the linking portion 10, at the time of print-forming, the length-b of the first region 8 in X-direction may be made more than twice the length-a (b>2*a*) by the amount corresponding to the increase in the number of slits to two.

REFERENCE SIGNS LIST

1, 20, 30, 40 chip resistor
2 insulating substrate
2A large-sized substrate
3 first front electrode (first electrode)
4 second front electrode (second electrode)
5 resistor
6, 7 connecting portion
8 first region
9 second region
9*a* oblique side
10 linking portion
11 first trimming groove
second trimming groove
12*a* straight portion
12*b* turn portion
S2 space

The invention claimed is:

1. A chip resistor comprising:

a rectangular parallelepiped insulating substrate;

a first electrode and a second electrode that are oppositely disposed on the insulating substrate with a predetermined interval therebetween; and a resistor that bridges the first electrode and the second electrode, the resistor having:

a first region connected to the first electrode and extending in a meandering shape;

a second region connected to the second electrode;

a linking portion positioned between the first region and the second region;

a first trimming groove for rough adjustment, the first trimming groove being disposed in the first region to lengthen an electric current path of the resistor;

a second trimming groove for fine adjustment, the second trimming groove being an L-cut shaped slit, including a straight portion and a turn portion, disposed in the second region;

a connecting portion in the second region located at a diagonal position of the linking portion and overlapping the second electrode; and a substantially triangular space with the connecting portion as an apex disposed between the second region and the second electrode, wherein a distance between the first electrode and the second electrode is an X-direction and a direction perpendicular to the X-direction is a Y-direction, the straight portion extends in the Y-direction from, as a start point, a side located on an extension line of the linking portion, and the turn portion extends in the X-direction from a distal end of the straight portion toward the space, and a distal end of the straight portion does not go beyond an imaginary line connecting a shortest distance between the linking portion and the connecting portion.

2. The chip resistor according to claim 1, wherein a resistor width serving as an electric current path of the first region defined by the first trimming groove, a resistor width serving as an electric current path of the second region defined by the second trimming groove, and a resistor width of the linking portion in the Y-direction are set substantially equal to each other.

3. The chip resistor according to claim 2, wherein the first trimming groove is an I-cut shaped slit that extends in the Y-direction from, as a start point, a central portion of the first region in the X-direction, and a length of the first region in the X-direction is set to about twice a length of the linking portion in the Y-direction.

* * * * *